US007227450B2

(12) United States Patent
Garvy et al.

(10) Patent No.: US 7,227,450 B2
(45) Date of Patent: Jun. 5, 2007

(54) INTERNET FACILITATED FIRE ALARM MONITORING, CONTROL SYSTEM AND METHOD

(75) Inventors: Patrick J. Garvy, Wallingford, CT (US); George P. Mancini, Wallingford, CT (US); Paul R. Bockisch, Oxford, CT (US); Andrew G. Berezowski, Wallingford, CT (US)

(73) Assignee: Honeywell International, Inc., Morristown, NJ (US)

( * ) Notice: Subject to any disclaimer, the term of this patent is extended or adjusted under 35 U.S.C. 154(b) by 283 days.

(21) Appl. No.: 10/800,368

(22) Filed: Mar. 12, 2004

(65) Prior Publication Data

US 2005/0200471 A1 Sep. 15, 2005

(51) Int. Cl.
*G08B 17/00* (2006.01)
*G08B 29/00* (2006.01)

(52) U.S. Cl. ..... 340/286.05; 340/506; 340/539.1

(58) Field of Classification Search ..... 340/286.05, 340/506, 539.1, 539.25, 511, 517, 520, 521, 340/524

See application file for complete search history.

(56) References Cited

U.S. PATENT DOCUMENTS

| | | | | |
|---|---|---|---|---|
| 6,369,705 | B1 * | 4/2002 | Kennedy | 340/506 |
| 6,400,265 | B1 * | 6/2002 | Saylor et al. | 340/531 |
| 6,693,530 | B1 * | 2/2004 | Dowens et al. | 340/506 |
| 6,737,967 | B2 * | 5/2004 | Farley | 340/514 |
| 6,831,557 | B1 * | 12/2004 | Hess | 340/539.16 |
| 6,838,986 | B2 * | 1/2005 | Shteyn | 340/531 |
| 6,917,288 | B2 * | 7/2005 | Kimmel et al. | 340/511 |
| 6,930,599 | B2 * | 8/2005 | Naidoo et al. | 340/539.1 |
| 6,950,016 | B2 * | 9/2005 | Farley | 340/514 |
| 6,972,676 | B1 * | 12/2005 | Kimmel et al. | 340/506 |
| 6,975,220 | B1 * | 12/2005 | Foodman et al. | 340/531 |
| 6,977,585 | B2 * | 12/2005 | Falk et al. | 340/506 |

* cited by examiner

*Primary Examiner*—John Tweel, Jr.
(74) *Attorney, Agent, or Firm*—Welsh & Katz, Ltd.

(57) ABSTRACT

A monitoring station displaced from a plurality of regional monitoring systems communicates therewith via a computer network, such as the Internet. The station can interrogate one or more selected systems and evaluate responses therefrom. The station can dispatch detector specific messages to a selected alarm system to retrieve data therefrom or forward commands or data thereto.

16 Claims, 5 Drawing Sheets

| Network ID | Node | Node Type | State | Silence Status | Label |
|---|---|---|---|---|---|
| 0 | 22 | Local NCS | on-line | N/A | |
| 0 | 40 | NFS-640 | on-line | Normal | |
| 0 | 88 | NFS-3030 | on-line | Normal | |
| 0 | 90 | NCA | on-line | N/A | |
| 23 | 1 | NFS-640 | on-line | Normal | |
| 23 | 5 | NFS-640 | on-line | Normal | |
| 23 | 56 | NFN-Gateway | on-line | N/A | |
| 23 | 60 | NFS-640 | on-line | Normal | |
| 23 | 62 | NFS-3030 | on-line | Normal | |
| 23 | 124 | Remote NCS | on-line | N/A | |
| 23 | 148 | NCA | on-line | N/A | |

Fig. 3

Network Statistics - Node 4

| NetId | Node | BFI | CRC | RecInit | RecDet | Xmit | Rcvd | Visible | Off-Line | Sl Mode | HX | HR | TX | TR |
|---|---|---|---|---|---|---|---|---|---|---|---|---|---|---|
| 23 | 13 | 0 | 0 | 0 | 0 | 0 | 0 | 0 | 0 | 0 | 0 | 193 | 0 | 0 |
| 23 | 20 | 0 | 0 | 0 | 0 | 0 | 0 | 0 | 0 | 0 | 0 | 194 | 0 | 0 |
| 23 | 70 | 0 | 0 | 0 | 0 | 409 | 350 | 0 | 0 | 0 | 0 | 193 | 0 | 11 |
| 23 | 80 | 0 | 0 | 0 | 0 | 0 | 0 | 0 | 0 | 0 | 0 | 193 | 0 | 88 |
| 23 | 81 | 0 | 0 | 0 | 0 | 69 | 7 | 0 | 0 | 0 | 0 | 193 | 0 | 15 |
| 23 | 82 | 0 | 0 | 0 | 0 | 0 | 16 | 0 | 0 | 0 | 0 | 196 | 0 | 0 |
| 23 | 84 | 0 | 0 | 0 | 0 | 0 | 16 | 0 | 0 | 0 | 0 | 196 | 0 | 0 |
| 23 | 86 | 0 | 0 | 0 | 0 | 0 | 0 | 0 | 0 | 0 | 0 | 193 | 0 | 22 |
| 23 | 100 | 0 | 0 | 0 | 0 | 0 | 16 | 0 | 0 | 0 | 0 | 198 | 0 | 0 |
| 23 | 106 | 0 | 0 | 0 | 0 | 0 | 17 | 0 | 0 | 0 | 0 | 198 | 0 | 0 |
| 23 | 108 | 0 | 0 | 0 | 0 | 0 | 16 | 0 | 0 | 0 | 0 | 196 | 0 | 0 |
| 23 | 120 | 0 | 0 | 0 | 0 | 0 | 14 | 0 | 0 | 0 | 0 | 199 | 0 | 0 |
| 23 | 126 | 0 | 0 | 0 | 0 | 0 | 0 | 0 | 0 | 0 | 0 | 193 | 0 | 0 |
| 23 | 140 | 0 | 0 | 0 | 0 | 0 | 0 | 0 | 0 | 0 | 0 | 193 | 0 | 20 |
| 23 | 144 | 0 | 0 | 0 | 0 | 0 | 0 | 0 | 0 | 0 | 0 | 193 | 0 | 10 |
| 23 | [illegible] | 0 | 0 | 0 | 0 | 0 | 0 | 16 | 0 | 0 | 104 | 0 | 0 | 0 |

Close

INTERNET FACILITATED FIRE ALARM MONITORING, CONTROL SYSTEM AND METHOD

FIELD OF THE INVENTION

The invention pertains to remote access and control of regional monitoring systems such as fire alarm, security systems, or the like. More particularly, the invention pertains to systems and methods for monitoring and controlling remote fire monitoring or security systems or the like via one or more computer networks, such as intranet or the Internet.

BACKGROUND OF THE INVENTION

Organizations which own, control or manage multiple sites such as businesses, property management groups, or government entities, are faced with a management and communication problem in that such remote and dispersed sites often include one or more continuously and independently operating fire alarm systems, security systems, building control systems or the like to monitor some or all of the regions of the respective properties. It's known to provide a communication link from fire monitoring systems to a local fire department for purposes of reporting one or more alarm conditions. However, such communication links do not necessarily provide warnings or alarm indications to organizational management which might be displaced hundreds of miles from the respective facility. Such links may not transfer information relative to the other types of systems.

While some properties are easily accessible, others may be remotely located and difficult to access. Hence, there continues to be an ongoing need to be able to remotely access, through dedicated lines or dial-up lines, displaced regional monitoring systems such as fire monitoring systems, security systems, building control systems or the like for diagnostic and maintenance purposes, downloading revised control software to reflect new construction or building renovations as well as to upgrade with additional features and the like. Preferably such communications could be carried out without having to create or establish dedicated communication systems to serve remote monitoring systems where such communication systems do not already exist. Preferably, usage of existing computer networks, such as the Internet, could be expanded to support such communications with displaced monitoring systems.

SUMMARY

A system that embodies the invention includes a plurality of spaced apart monitoring systems. Each of the systems includes at least one port for communicating, via a computer network to a displaced monitoring apparatus, and, a monitoring apparatus which includes at least one port for communicating, via the computer network, with each of the systems including software for accessing the status of at least one region being monitored by a respective selected system.

BRIEF DESCRIPTION OF THE DRAWINGS

FIG. 3 is another screen illustrating some of the features of a system in accordance with the invention;

DETAILED DESCRIPTION OF THE INVENTION

Figure 1:
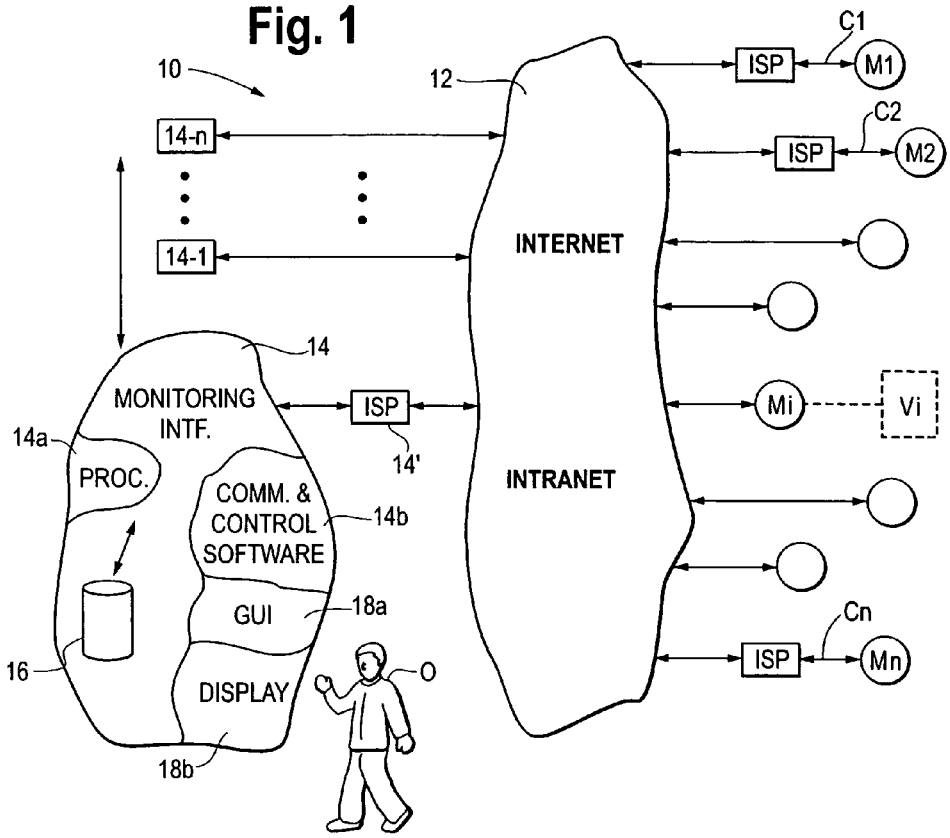
FIG. 1 is a block diagram of a system in accordance with the invention.

While embodiments of this invention can take many different forms, specific embodiments thereof are shown in the drawings and will be described herein in detail with the understanding that the present disclosure is to be considered as an exemplification of the principles of the invention and is not intended to limit the invention to the specific embodiment illustrated.

In accordance with the invention, computer networks, either an intranet or the Internet can be used to communicate with and control displaced, or remote, fire monitoring systems, security systems or building control systems all without limitation. One or more monitoring interfaces can communicate with the members of a plurality of displaced fire monitoring, security or building control systems via the Internet. The remote monitoring interface(s) can obtain from the local monitoring systems status information relative to building conditions, developing fires, alarm notifications, all without limitation. Such information can be used to remotely evaluate the status and ongoing circumstances at the region or regions being monitored by a respective fire security or building control system.

In one aspect, maintenance requests or testing can be initiated via the remote monitoring interface in the absence of operators being on site at the various fire, security or building control systems being monitored. Reports can be generated at the displaced monitoring interface(s) which reflect the various system operational parameters, ongoing conditions and the like at the various sites. In this regard, the various monitoring systems can provide real time event notification of developing fire conditions, security conditions or building conditions to a displaced monitoring interface via a computer network such as the Internet. For security purposes the data could be encrypted before transmission.

In another aspect, the displaced monitoring interface can, through a multi-level communication process, activate or deactivate monitoring units such as ambient condition detectors and the like associated with a respective alarm system. The parameters and operational characteristics of such monitoring units can be evaluated remotely at the monitoring interface. Those units which are in need of maintenance can be identified to provide feedback to on-site personnel. Alternately, the remote monitoring interface can provide commands, control programs or other data to selected electrical units for purposes of carrying out remote maintenance and/or testing of same. For example, walk testing can be carried out between local on-site maintenance personnel and a remote operator at the monitoring interface.

In another aspect, updated control programs can be downloaded to one or more of the displaced operating monitoring systems based on building renovation, construction, upgrades or additional system capabilities all without limitation. Alternately, sensing or electrical units of a respective system can be remotely disabled during building construction or maintenance so as to avoid degeneration of the false alarms.

In yet another aspect, reliability between the monitoring interface and the remote operating systems can be enhanced by the availability of a plurality of channels accessible via the Internet to carry out the communications.

Each of the remote operating units is uniquely identifiable by a pre-assigned IP address. Additional identifying information such as serial number or the like can be provided to authenticate a data source as well as data received from such a source. In yet another aspect, not only can the operational capability of a remote monitoring system be evaluated, a failure of such system can be established at the displaced monitoring interface for purposes of providing information to organizational management.

In another embodiment, the specified regional monitoring system can include cameras, such as video cameras, for visually monitoring a region, or zone. Signals corresponding to the real-time visual images can be transmitted, via the computer network, to the remote monitoring interface for visual presentation to the operator. These images could in-turn assist the operator in providing input to the respective monitoring system.

FIG. 1 illustrates an embodiment 10 of a multiple unit communication system in accordance with the invention. A plurality of displaced network enabled regional monitoring systems M1, M2 . . . Mn can communicate using communications links C1, C2 . . . Cn (and local ISPs) either via the Internet 12 or an intranet, if such exists, with a displaced monitoring interface 14, via local ISP 14-1 Such a configuration takes advantage of existing Internet or intranet communication protocols as well as existing communication hardware for carrying out such processes thereby dispensing with having to construct one or more dedicated communication systems.

The monitoring interface 14 can incorporate one or more databases 16 which include information as to the status, operational characteristics and equipment/software associated with each of the monitoring systems M1, M2 . . . Mn. Monitoring interface 14 can include one or more processors 14*a* as well as control and communications software 14*b* which can be stored, recorded on, storage medium 16 for retrieval and execution by processors 14*a*.

A plurality of additional monitoring interfaces 14-1 . . . 14-*n* can also be provided. The interface 14, 14-1 . . . 14-*n* can communicate directly with each other or via the network 12. Software, at each of the interfaces can provide for one interface having priority over all of the others.

Those of skill in the art will understand that each of the monitoring systems, such as Mi, could itself represent a local communications system of a type disclosed for example in Berezowski et al. U.S. Pat. No. 5,539,389 or Anderson U.S. Pat. No. 5,627,515 both assigned to the assignee hereof and incorporated by reference. The monitoring systems, such as Mi could also include a local intranet. Neither the structure nor the characteristics of the various systems M1, M2 . . . Mn are limitations of the invention.

An operator O can communicate with the monitoring interface 14 via graphical user interface software 18*a* and display 18*b*. It will be understood that the characteristics and capabilities of the graphical user interface 18*a* as well as the display 18*b* may vary and are not limitations of the present invention. Similarly, communication links such as C1, C2 . . . CN between the monitoring units M1 . . . Mn and their respective Internet Service Providers, in an Internet communication environment, may vary and are not limitations of the present invention. Nor are the local Internet Service Provider 14-1, or the types of communication links between monitoring interface 14 and the computer network 12 limitations of the present invention.

Those of skill will understand that the monitoring interface 14 can select one or more of the remote monitoring or control systems M1 . . . Mn using a respective URL or IP address to communicate therewith. Once a communication link Operator O, via the graphical user interface 18*a* can evaluate the operational and performance characteristics of the system Mi including operational and performance characteristics thereof. The various detectors or sensors which are present in the system without limitation can be evaluated, tested, taken off-line or upgraded from the interface 14.

If the respective monitoring system Mi includes video cameras, Vi illustrated in phantom, those images can be transmitted to interface 14 for viewing by operator O. Such real-time images could greatly assist operator O in managing a remote hazardous condition.

Figure 2:
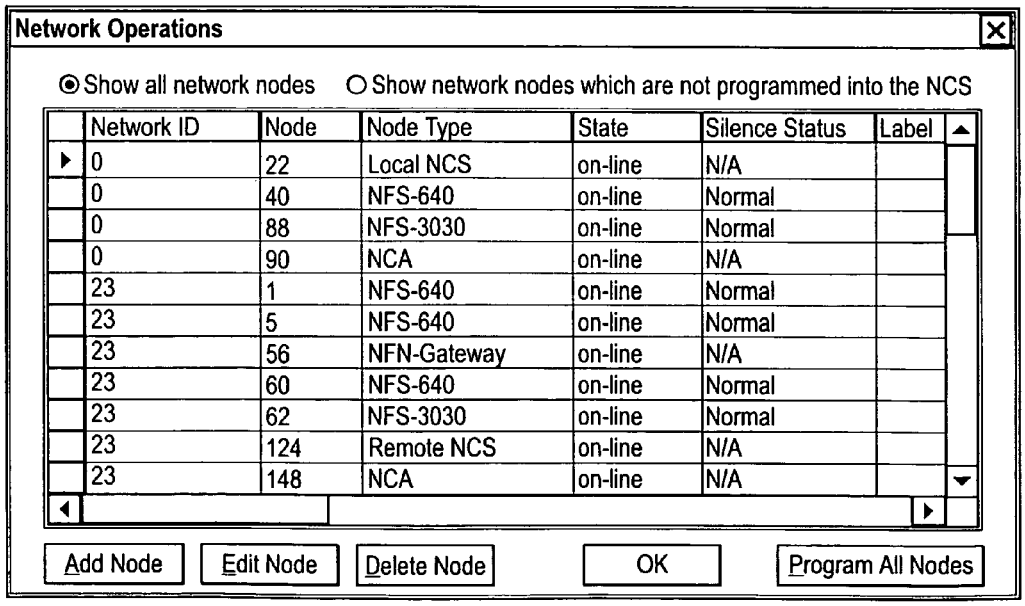
FIG. 2 is a screen illustrating some of the features of a system in accordance with the invention.

FIG. 2 illustrates a set-up screen presentable on display 18*b* by graphical user interface 18*a* to the operator O. Using the screen of FIG. 2, an operator can add systems M1, M2 . . . Mn, identified as nodes in FIG. 2, to the available plurality which can be interrogated and evaluated. The screen of FIG. 2 also provides information such as type-of system or node, its current state and status information.

FIG. 3 is one of a plurality of information or statistical screens available for selected system M4 or node 4 of the plurality. As illustrated in FIG. 3, parametric information for a selected system can be presented for operator review remotely at interface 14.

Figure 4:
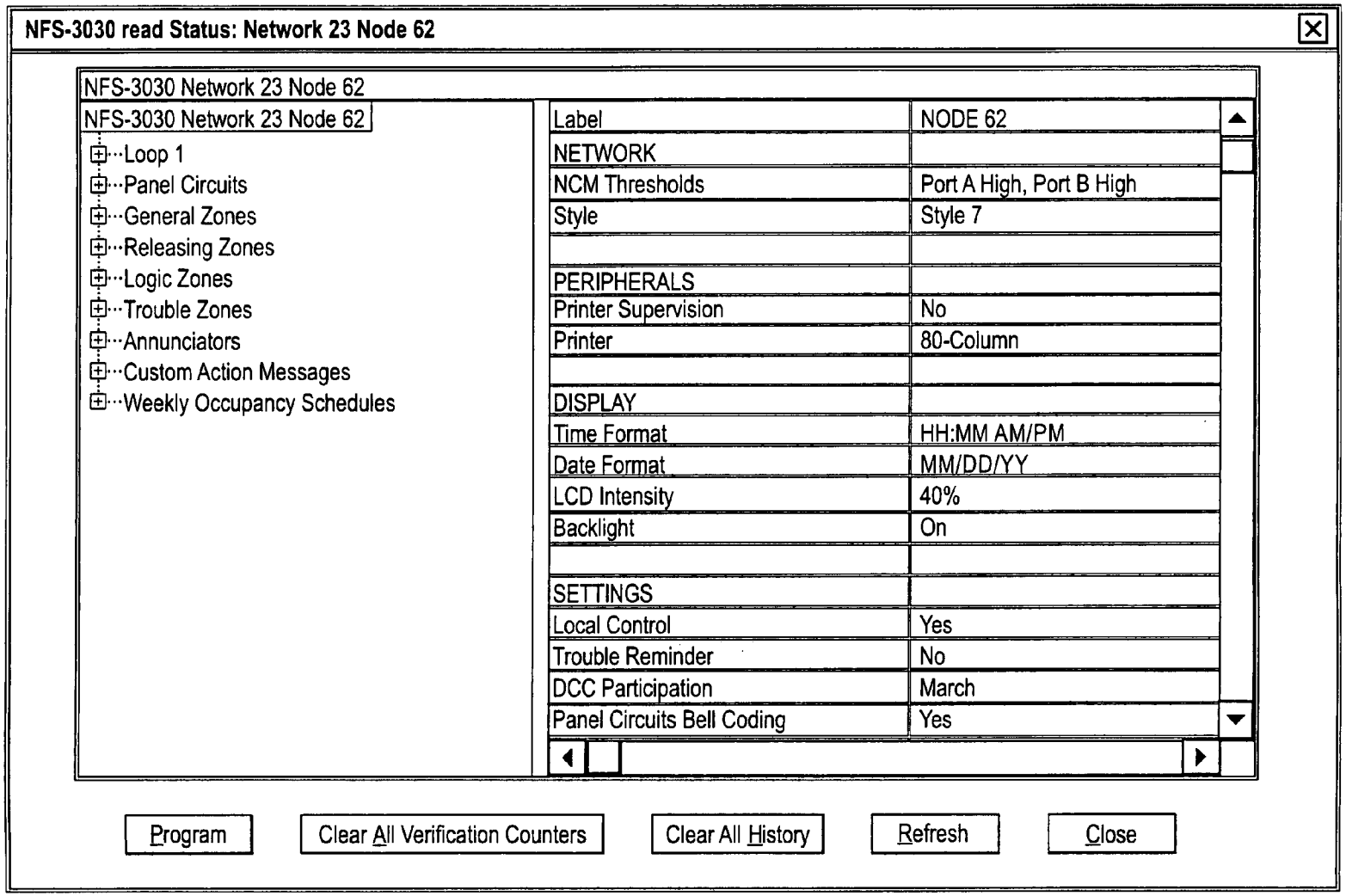
FIG. 4 is yet another screen illustrating some of the features of a system in accordance with the present invention.

FIG. 4 presents status information for a selected system, node 62. Using the screen of FIG. 4, operator O can remotely program the characteristics of the selected system, clear verification counters, clear prior history. Other actions can be taken via monitoring interface 14.

Figure 5:
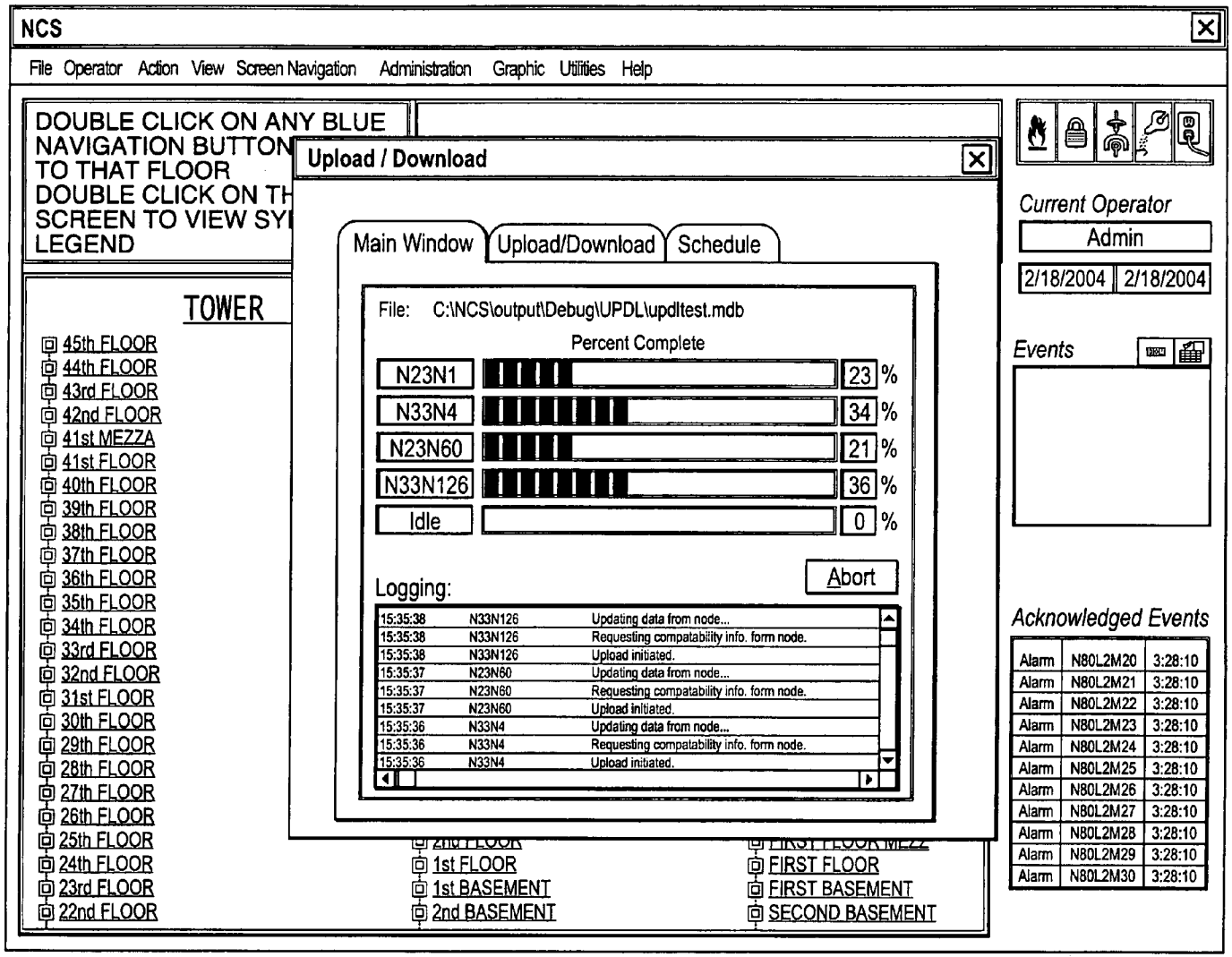
FIG. 5 is another screen illustrating some of the features of a system in accordance with the present invention.

The screen of FIG. 5 provides status information as to uploading or downloading information, programs or the like between monitoring interface 14 and one or more of the systems M1, M2 . . . Mn. The screen of FIG. 5 also provides an indication of percentages of completion of the requested activity.

Figure 6:
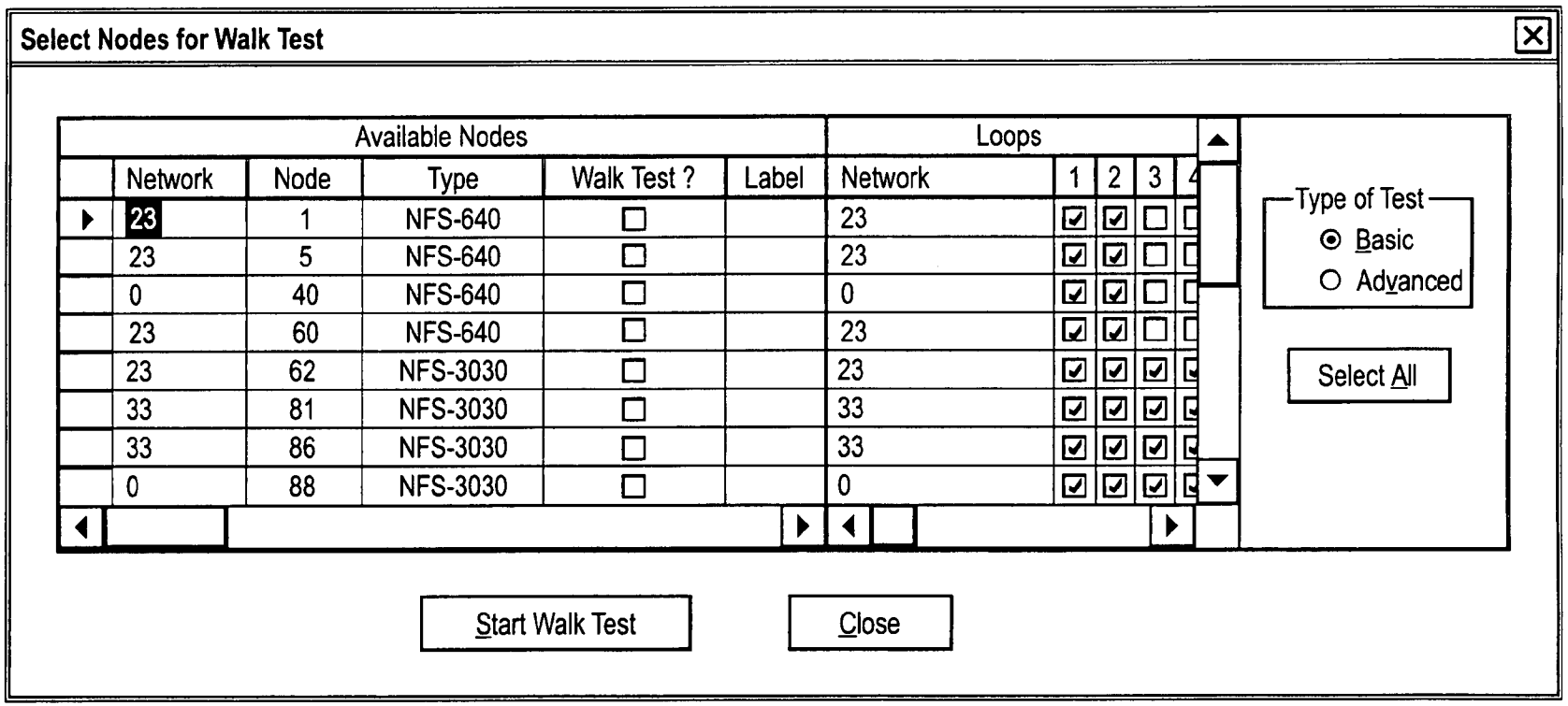
FIG. 6 is a further screen illustrating some of the features of a system in accordance with the present invention.

The screen of FIG. 6 enables an operator O to identify a node or a system at which a walk test is to be carried out in conjunction with local personnel. A loop or loops to be tested can be identified. Types of tests can be specified. Additionally, a light button is provided to initiate the start of the walk test. The screen of FIG. 6 brings to the user U on a displaced basis, an ability to test the operational characteristics of various ambient condition detectors present at a selected system or node.

It will be understood that the above selection of screens is exemplary only and other capabilities or functionalities can be provided to operator O on a local basis via monitoring interface 14. Usage of the computer network 12 to carry out communication with displaced monitoring systems such as M1, M2 . . . Mn brings to the operator O those functions and capabilities which might otherwise be available to an operator local to the respective system, such as system Mi. For example, and without limitation, the assignee hereof, via its Notifier Division, has printed and distributed an operational manual for a Network Control Station of an intranet which includes various types of fire monitoring subsystems and equipment. That manual, *ONYX Network Control Station NCS* Document 51658, publ. Nov. 12, 2003, Rev. C by Notifier Division of assignee, incorporated herein by reference, includes additional information on local control screens previously accessible via the local intranet. All such screens and control functions can be, in accordance with the invention, accessible remotely at monitoring interface 14 via Internet 12. Thus, the operator O has direct, though remote, control over all such system functions, or, can access all such system data.

When more than one remote monitoring station 14, 14-1 . . . 14-*n* is employed, they may be co-located and connected via a local area network with one or more Internet connections. They may also be located remotely from each other via only an Internet connection. When more than one remote monitoring station is employed, the display and control features described in Appendix F of the above-identified, previously incorporated document can be optionally extended to the remote monitoring stations. Use of these features ensures that when there are multiple operators, all operators are aware of which operator is in control.

Control can be relative to one or more monitoring systems Mi, or, relative to one or more monitoring interfaces 14, 14-1 . . . **14-*n***. The plurality of regional monitoring systems can be subdivided to form groups. When subdivided, one operator can control one such group while another operator can control a different group. The display and control functions can be used to identify and transfer control of the subgroups between operators.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A system comprising:

a plurality of spaced apart monitoring systems, each of the systems includes at least one port for communicating, via a computer network to a displaced monitoring apparatus;

a monitoring apparatus displaced from members of the plurality, the apparatus includes at least one port for communicating, via the computer network, with each of the systems including software for accessing the status of at least one region being monitored by a respective selected system, the apparatus including additional software for carrying out a walk test at a selected, remote monitoring system, and including control circuitry to transmit software to a selected monitoring system for execution thereat.

2. A system as in claim 1 which includes additional software for modifying a parameter setting, related to fire monitoring, at a respective selected system.

3. A system as in claim 1 where the apparatus includes software for determining the presence of an abnormal condition at a respective selected monitoring system.

4. A system as in claim 3 which includes additional software to modify at least one parameter, responsive to the presence of the abnormal condition, of the selected monitoring system.

5. A system as in claim 1 where each of the monitoring systems is specifiable by a pre-assigned network identifier.

6. A system as in claim 5 where the apparatus includes software enabling a user of the apparatus to interact with a specified, remote monitoring system substantially in real-time in evaluating at least a selected operational characteristic thereof.

7. A system as in claim 6 where the operational characteristic comprises a sensitivity parameter of an ambient condition detector of the selected monitoring system.

8. A computer readable medium with software recorded thereon, said software comprising:

first software enabling displaying of selectable identifiers for a plurality of displaced monitoring systems;

second software enabling displaying of status information relative to at least one selected system;

third software enabling an operator to select an ambient condition detector in the at least one selected system and forward a command thereto via a computer network; and fourth software enabling displaying a walk test control screen.

9. A computer readable medium as in claim 8, which includes:

additional software to enable communication with a selected monitoring system via the Internet.

10. A computer readable medium as in claim 9 with the third software including control software to enable establishing an operator specified detector parameter to be forwarded via the Internet to the selected system for installation at the detector.

11. A computer readable medium as in claim 10 which includes pre-stored information relative to the selectable monitoring systems.

12. A computer readable medium as in claim 11 which includes retrieval software to enable obtaining pre-stored information relative to a selected monitoring system.

13. A computer readable medium as in claim 8 which includes additional software for enabling displaying of images received from an identified, displaced monitoring system.

14. A computer readable medium with software recorded thereon, said software comprising:

first software enabling displaying of selectable identifiers for a plurality of displaced monitoring systems;

second software enabling displaying of status information relative to at least one selected system;

third software enabling an operator to select an ambient condition detector in the at least one selected system and forward a command thereto via a computer network; and fourth software enabling displaying of a walk test control screen;

additional software enabling a selected monitoring system to communicate via the Internet;

with the third software including control software to enable establishing an operator specified detector parameter to be forwarded via the Internet to the selected system for installation at the detector;

which includes pre-stored information relative to the selectable monitoring systems;

where the control software enables transmission, via the Internet, of executable programs to at least one selected monitoring system for execution thereat.

15. A computer readable medium as in claim 14 when the control software enables transmission of one of data or a program to be installed in a selected ambient condition detector of a selected monitoring system.

16. A system comprising:

a plurality of spaced apart monitoring systems, each of the systems includes at least one port for communicating, via a computer network to a displaced monitoring apparatus;

a monitoring apparatus displaced from at least some of the members of the plurality, the apparatus includes at least one port for communicating, via the computer network, with each of the systems including software for accessing the status of at least one region being monitored by a respective selected system the apparatus including interface software for displaying a walk test control screen; and at least some of the plurality of spaced apart monitoring systems include a wireless port for wirelessly communicating with the computer network.

* * * * *